US009212514B2

(12) United States Patent
Joray

(10) Patent No.: US 9,212,514 B2
(45) Date of Patent: Dec. 15, 2015

(54) GLAZING WITH ENCASEMENT PIVOTALLY MOUNTED ABOUT AN AXIS IN A FIXED OPENING FRAME

(75) Inventor: Eric Joray, St-Aubin (CH)

(73) Assignee: Orchidees Constructions S.A., Onnens (CH)

( * ) Notice: Subject to any disclaimer, the term of this patent is extended or adjusted under 35 U.S.C. 154(b) by 522 days.

(21) Appl. No.: 12/736,066

(22) PCT Filed: Mar. 3, 2009

(86) PCT No.: PCT/IB2009/050857

§ 371 (c)(1),
(2), (4) Date: Nov. 8, 2010

(87) PCT Pub. No.: WO2009/109914

PCT Pub. Date: Sep. 11, 2009

(65) Prior Publication Data

US 2011/0146160 A1 Jun. 23, 2011

(30) Foreign Application Priority Data

Mar. 3, 2008 (EP) ..... 08102225

(51) Int. Cl.
*E05D 7/08* (2006.01)
*E06B 3/40* (2006.01)

(52) U.S. Cl.
CPC ..... *E06B 3/40* (2013.01)

(58) Field of Classification Search
USPC ..... 49/381, 388, 389, 390, 391, 392, 393, 49/394, 316
See application file for complete search history.

(56) References Cited

U.S. PATENT DOCUMENTS

| | | | | | |
|---|---|---|---|---|---|
| 2,307,647 | A | | 1/1943 | Starck | |
| 2,750,015 | A | * | 6/1956 | Hauck | 49/392 |
| 2,781,560 | A | * | 2/1957 | Ziesmer | 16/329 |
| 2,811,754 | A | * | 11/1957 | Toth | 49/316 |
| 2,892,220 | A | * | 6/1959 | Gillespie | 49/390 |
| 2,902,729 | A | * | 9/1959 | Gillespie | 49/390 |
| 3,239,893 | A | * | 3/1966 | Lundgren | 49/390 |
| 3,335,523 | A | * | 8/1967 | Isler et al. | 49/168 |
| 3,768,204 | A | * | 10/1973 | Anderberg et al. | 49/390 |
| 3,771,264 | A | * | 11/1973 | Sawle | 49/390 |
| 3,911,623 | A | * | 10/1975 | Walter | 49/390 |
| 4,080,758 | A | * | 3/1978 | Hubbard | 49/390 |
| 4,081,934 | A | * | 4/1978 | Franz | 52/171.3 |

(Continued)

FOREIGN PATENT DOCUMENTS

| | | | |
|---|---|---|---|
| CH | 349402 | A | 10/1960 |
| DE | 3943123 | C1 | 6/1991 |

*Primary Examiner* — Katherine Mitchell
*Assistant Examiner* — Shiref Mekhaeil
(74) *Attorney, Agent, or Firm* — Krieg DeVault LLP; Clifford W. Browning

(57) ABSTRACT

In order to pivot the encasement provided with glass panes about the pivotal axis thereof in an opening frame, a mobile blade at the bottom of the frame is pressed down and the pivotal movement is initiated in one direction or the other after unlocking the spring blocks bearing the blades covering the grooves of the vertical profiles of the frame. The seal having a U profile slightly lifts the blade and the covering blade of the upper profile of the frame, whereby the pivoting of the frame is continued until, if the lower blade has been released in the meantime, the ledge of the flange of the upper profile of the encasement abuts the side edge of this same blade while the ribbed blade enters the opening of the U seal of the upper profile.

7 Claims, 7 Drawing Sheets

(56) References Cited

U.S. PATENT DOCUMENTS

| | | | | | |
|---|---|---|---|---|---|
| 4,086,727 | A * | 5/1978 | Kuyper et al. | 49/255 |
| 4,307,542 | A * | 12/1981 | Lense | 49/318 |
| 4,351,131 | A * | 9/1982 | Kubik | 49/501 |
| 4,428,154 | A * | 1/1984 | Rinehart | 49/390 |
| 5,083,398 | A * | 1/1992 | Kolbeck et al. | 49/395 |
| 5,398,446 | A * | 3/1995 | Kunert | 49/169 |
| 6,986,225 | B2 * | 1/2006 | Gjersoe et al. | 49/388 |
| 7,487,616 | B2 * | 2/2009 | Deaver | 49/498.1 |
| 7,765,741 | B2 * | 8/2010 | Miller et al. | 49/394 |
| 2008/0000164 | A1 * | 1/2008 | Erickson et al. | 49/394 |
| 2009/0211161 | A1 * | 8/2009 | Dries | 49/381 |
| 2009/0265991 | A1 * | 10/2009 | Ito et al. | 49/161 |

* cited by examiner

GLAZING WITH ENCASEMENT PIVOTALLY MOUNTED ABOUT AN AXIS IN A FIXED OPENING FRAME

This application claims the benefits under 35 U.S.C. 119 (a)-(d) or (b), or 365(b) of International Application No. PCT/IB2009/050857 filed 3 Mar. 2009, and European Patent Application No. 08102225.3, filed 3 Mar. 2008.

TECHNICAL FIELD

The present invention relates to a glazing pivotally mounted about an axis in a fixed opening frame. It aims at providing a glazing liable to pivot by 180 degrees about its own axis and provided with sealing means and locking means which can be actuated in a closing position as well as in the opposite closing position of the glazing.

STATE OF THE ART

The utilization of large glazed picture windows, which are more and more often used in the construction of buildings, meet some problems which have not been solved yet. Thus, when such picture windows are placed in height, cleaning, and more generally, any maintenance work to be carried out on the outer surface thereof, are often difficult and expensive. On the other hand, the manufacturing of glass presently offers the possibility of selectively manufacturing plates having various properties, for example, reflexion, energy transmission, light transmission, or transparency to infrared light, etc. It has thus been established that many of the mentioned problems could be solved by offering to position a pivoting glazing, so that it could pivot by 180 degrees about its axis, so that the surface previously outside would be inside. For example, an insulating glass having an energy transmission (value g) depending on the orientation thereof, in an optimized form, could allow significant money saving.

Glazed encasements which can pivot by 180 or 360 degrees are already known from documents CH 349 402 A and DE 39 43 123 C1.

DISCLOSURE OF THE INVENTION

The aim of the invention is to provide a glazing provided with an encasement and mounted in a fixed opening frame, liable to pivot by 180 degrees, and offering safety and simplicity advantages for the handling as well as for the cleaning and maintenance operations with respect to the devices of the prior art.

For this purpose, the present invention relates to a set including a glazing provided with an encasement pivotally mounted about an axis in a fixed opening frame, and so arranged as to enable a pivoting angle of the glazing about said axis by 180 degrees, with means providing, on the one hand, the sealing and, on the other hand, the locking of the encasement with respect to the frame, characterized in that the fixed opening frame includes two frame elements having a quadrangular shape, with each one being formed with rectilinear segments of profiles and positioned against each other, one on the inside and the other one on the outside, in that said pivoting axis of the encasement is borne by the outside frame element, in that the glazing encasement includes segments of profiles provided with two opposite flanges, perpendicular to the plane of the glazing, symmetrical and each one being provided with a groove filled by a sealing member, with one flange being on the inside and the other one being on the outside of the glazing, and in that the inner element of the fixed frame of the set is provided with mobile flat blades, mounted on fixed segments of profiles, with the planes of said blades being perpendicular to the plane of the glazing and such blades cooperating, in the closing position, with said sealing members.

Other significant characteristics of the glazing of the invention are defined in the sub-claims, depending on claim 1.

BRIEF DESCRIPTION OF THE DRAWINGS

One embodiment of the object of the invention is described hereinunder as an example thereof, while referring to the appended drawings, wherein.

DETAILED DESCRIPTION OF THE EMBODIMENTS OF THE INVENTION

Figure 1:
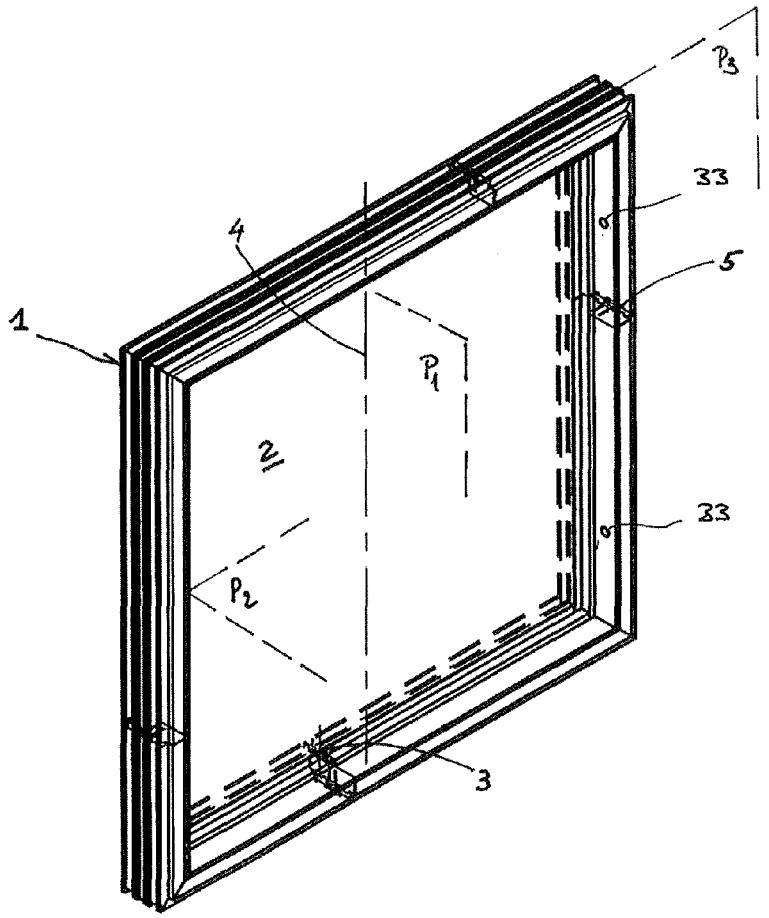
FIG. 1 is a perspective view at a reduced scale, of the glazing, in the closed condition.
Figure 1A:
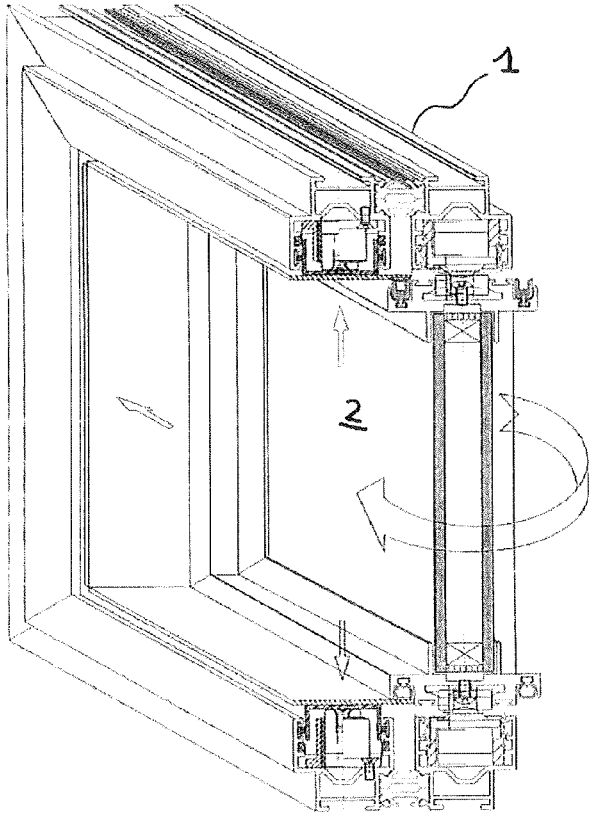
FIG. 1*a* is a view similar to FIG. 1, the glazing being cut out along the vertical plane P1 illustrated in FIG. 1.
Figure 2:
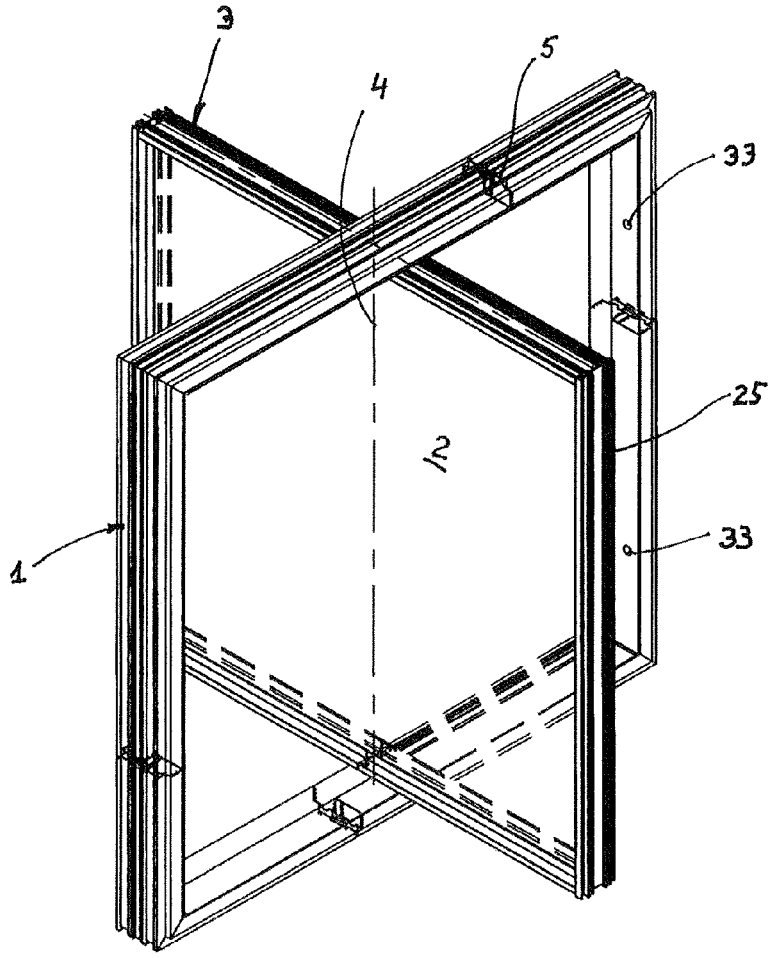
FIG. 2 is a view similar to FIG. 1 showing the glazing in open condition, at 90 degrees.

In FIGS. 1 and 2, the glazing is shown in respectively closed, and open at 90 degrees, positions, in its frame 1. The frame is fixed by conventional means in one opening of a wall, a window, a picture window which can be positioned at the lower level of a building as well as at a higher level. The glazing 2 is borne by an encasement 3 and pivots about a pivot axis 4 shown by a mixed line in FIGS. 1 and 2, which uses pivoting means which shall be described hereinafter. In the embodiment shown, the glazing 2 has a rectangular shape and the pivot axis 4 is vertical and positioned in the middle of the base of the glazing 2, so that such glazing 2, when pivoting by 180 degrees, returns to the same initial position, since only the inner and outer faces have been swapped.

The frame 1 includes two adjacent elements, namely an inner element 1*a* and an outer element 1*b*, attached to each other and each one being composed of four segments of profiles 5 made of a metal or another material, assembled as a quadrilateral, whereas the encasement 3 includes only one element formed with four segments of profiles 25 assembled as a quadrilateral.

Figure 3:
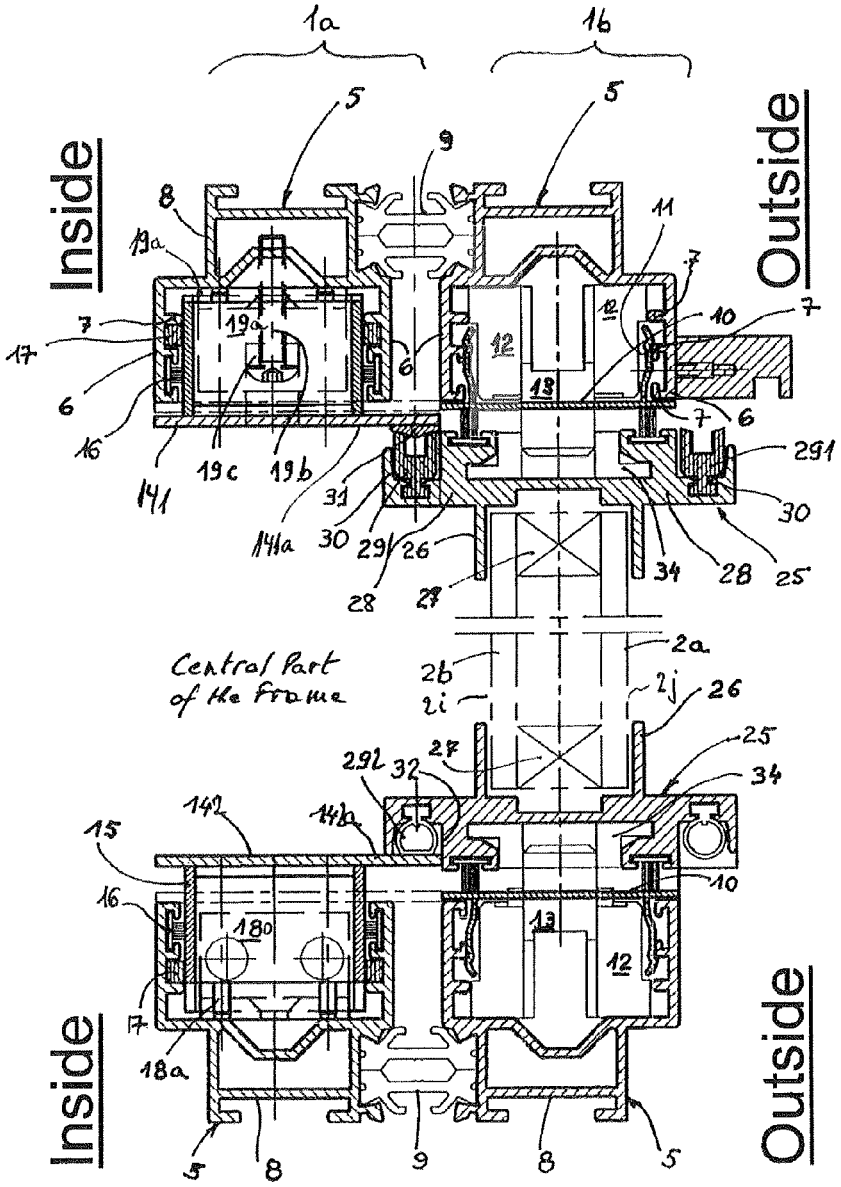
FIG. 3 is a shrunked cross sectional view along the vertical plane P1 showing the elements of the glazing frame and encasement, in closed position.
Figure 4:
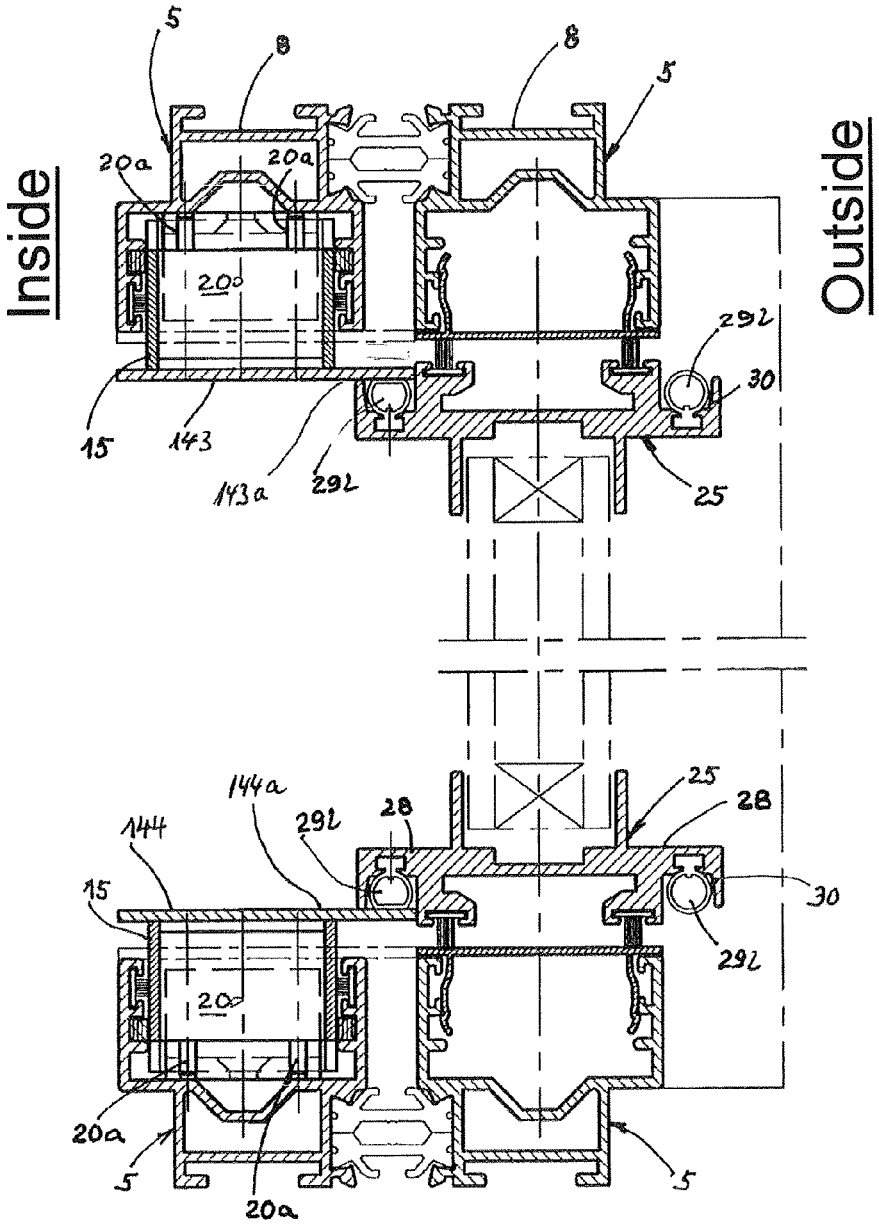
FIG. 4 is a cross sectional view similar to FIG. 3 showing, still in closed condition, the frame and encasement elements in cross section along the horizontal plane P2 illustrated in FIG. 1.

The elements of the frame 1 and of the encasement 3 can be seen, in cross section, in FIG. 3, as regards the upper and lower horizontal sides, and in FIG. 4 as regards the vertical sides. The segments of profiles 5 are rectilinear and assembled at the ends thereof, for example by riveting or any other means. The cross section of a segment of profile 5 is that of a U, providing an open inner space intended for receiving prefabricated elements which will be described hereinafter. Such space is limited by two parallel flanges 6, the inside of which is provided with profile slides 7. At the base thereof, between the flanges, a structure 8 extends, which is designed for stiffening the profile and including a trapezoidal bar, two parallel walls and a plane bottom bar. The U-shaped profile of all the segments of profiles 5 composing the two adjacent elements 1*a*, 1*b* of the frame 1 opens on the inside, so that the structures 8 of the bottom of the profile can, for example, be buried in an anchoring system belonging to the encasement. In addition, the two adjacent elements 1*a*, 1*b* of the frame 1 are assembled by intermediate seals 9 accommodated between the stiffening structures 8 and fixing the distance between the frame elements.

Prior to giving the description of the encasement and of the glazing, we shall give the list of the added members which are provided on the grooves of the segments of profiles 5 of the frame 1. As for the outer element of the frame 1, FIGS. 3 and 4 show that the segments of profiles 5 are equipped with a covering blade 10 closing inwards the groove-shaped space of the profile. Such covering blades 10 are provided, outside, with elastic blades 11 bent so as to cling to the edges of one of the profile slides 7. However, as can be seen in FIG. 3, in the middle of the upper and lower sides of the outer element 1*b* of the frame 1, the covering blades 10 are interrupted to give room to added rectangular blocks 12, and provided with fixed dowels 13 intended for pivoting the glazing frame.

As for the inner element 1*a* of the frame 1, the segments of profiles 5 thereof are provided with multiple auxiliary members intended for sealing the frame-encasement set and for locking the encasement 3. Thus, firstly, four sealing blades 141, 142, 143, 144 thicker than the covering blades 10 and movable perpendicularly to the segments of profiles 5 which they top, extend on the whole length thereof. The inner edge of the sealing blades 141, 142, 143, 144 extends up to the limit of the inner faces of the flanges 6 of the segments of profiles 5. On the contrary, on the outer edge adjoining the outer element 1*b* of the frame 1, the sealing blades 141, 142, 143, 144 have a widening 141*a*, 142*a*, 143*a*, 144*a*, and the outer edge thereof extends up to the limit of the outer faces of the flanges 6 of the segments of profiles 5 belonging to the outer element 1*b* of the frame 1. We shall see hereinafter that the sealing blades 14 play the role of mobile covers, with the side widening 141*a*, 142*a*, 143*a*, 144*a* playing a specific function. A packing 31 is fixed on the widening 141*a* of the sealing blade 141 at the upper side of the inner element la of the frame 1 (FIG. 3). Such packing 31 is one to two millimeter thick and has a trapezoidal profile with a central rib.

Each one of the sealing blades 141, 142, 143, 144 is borne by two longitudinal ribs 15 integral with the sealing blades and engaged between the flanges 6 of the segments of profiles 5 in which they are mounted. Brushes 16 and beads 17 made of synthetic material are engaged between the flanges 6 and the longitudinal ribs 15 so as to guide the sealing blades 141, 142, 143, 144 provided with the ribs 15, in translation, perpendicularly to the segments of profiles 5.

Figure 6:
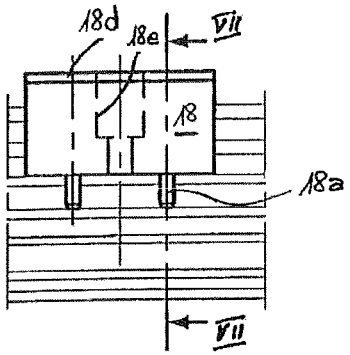
FIG. 6 is a front view of an exemplary spring block which can be used in the encasement shown in FIG. 3, and FIGS. 7 and 8 are respectively a cross sectional view along line VII-VII and a top view of the block in FIG. 6.
Figure 7:
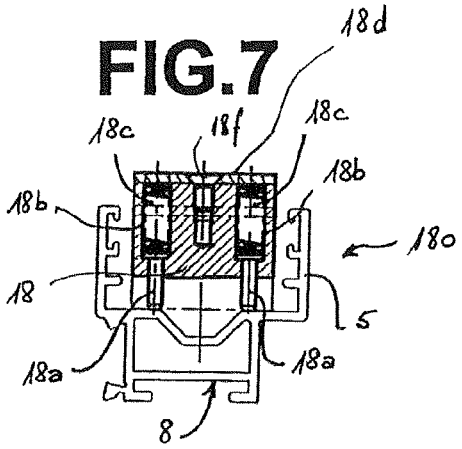
Figure 8:
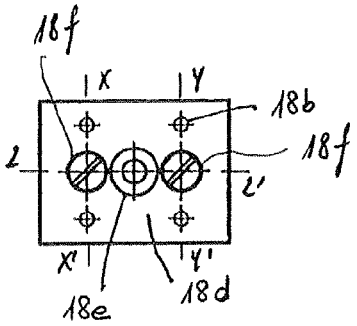

The strokes of the sealing blades 141, 142, 143, 144 provided with the ribs 15 are adjusted in different ways. The movements thereof are controlled by prefabricated members composed of spring blocks. In fact, such spring blocks can be executed in three different ways, as explained hereinunder. In the lower part of FIG. 3, a spring block 180 can be seen, a detailed example of construction of which is shown in FIGS. 6 to 8. Four rods 18*a* provided with flat head at one of their ends are buried in four cylindrical drills 18*b*, provided with an internal shoulder, the rods 18*a* being provided in a block 18 and actuated by springs 18*c* held by a cover plate 18*d*. The block 18 having the shape of a rectangular parallelepiped is machined on all the faces thereof and the four cylindrical drills 18*b* are located at the four corners of the block 18. The four rods 18*a*, which can be flat headed pins, are engaged in the drills 18*b*, so that the flat heads of the rods 18*a* rest against the shoulders of the drills 18*b*. The four springs 18*c* are engaged in the drills 18*b* and held by the cover plate 18*d* screwed to the block 18 through two screws 18*f* aligned along a central axis ZZ' of the block 18, each screw 18*f* being aligned with two rods 18*a* respectively along axes XX' and YY'. It should be understood that the stroke of the springs 18*c*, and consequently, the stroke of the rods 18*a*, are selected so as to be able to give the sealing blade 142, positioned in the lower side of the inner element 1*a* of the frame 1, a given stroke between the lower position and the upper position thereof in which a tubular seal 292 is compressed, as shown in solid lines in FIG. 3 and as better explained in the following paragraphs. A recess 18*e* provided at the centre of the plate 18*d* can be used for fixing the block 18 to the sealing blade 142, if so required. The springs 18*c* can be replaced by any other appropriate elastic elements. Several spring blocks 180 support the sealing blade 142 placed horizontally at the base of the frame 1.

Spring blocks 190 are placed in the segment of profile 5 positioned at the upper side of the inner element 1*a* of the frame 1. The construction of such spring blocks 190 is similar to that of the spring blocks 180, but are different on two points: firstly, the rods 19*a* are shorter than the rods 18*a*, so that the possible stroke of the spring blocks 190 is very limited, and, secondly, each spring block 190 is held in the structure 8 of the segment of profile 5 by an adjustable screw 19*b*, which can be adjusted using a cross-piece 19*c*. The possible stroke of the spring blocks 190, which control the stroke of the sealing blade 141 positioned at the upper side of the inner element 1*a* of the frame 1, is approximately comprised between 1 mm and 3 mm. The rotation of the glazing 2, respectively of the segments of profile 25, displaces the sealing blade 141 in the upward vertical direction, through the movement of the "concave" section of the U-shaped seal 291 on the packing 31.

Figure 5:
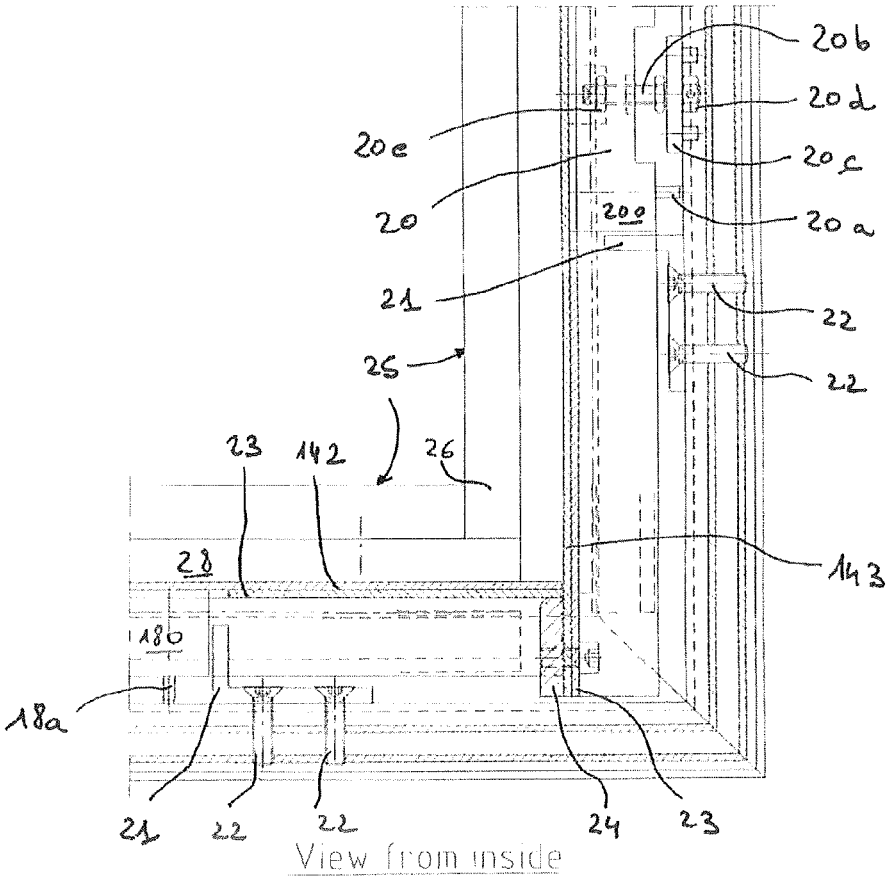
FIG. 5 is a cross sectional view, along the plane P3 parallel to the glazing illustrated in FIG. 1, showing, at the same scale as FIGS. 3 and 4, the bottom right corner of the closed glazing, as seen from inside.

An alternative spring block 200 is used in the segments of profiles 5, which form the two vertical sides of the inner element 1*a* of the frame 1 (refer to FIGS. 4 and 5). Such spring blocks 200 have larger dimensions, more particularly in length, than the spring blocks 180, and it can be seen, in FIG. 5, that they are provided, at the centre of the length thereof, with screwing adjustment means, which enable to lock or unlock the encasement 3 at will. A threaded rod 20*b* (FIG. 5), the base of which includes a cylindrical segment rotating in a plate 20*c* goes through a block 20 of the spring blocks 200. Such spring block 200 is fixed in the trapezoidal bar of the structure 8 of the segment of profile 5, by a nut 20*e* and a bolt 20*d*, but leaves enough clearance to allow it to rotate. The axial position of the threaded rod 20*b* is fixed by the nut 20*e* and the bolt 20*d*, and the thread thereof goes through the block 20, so that the block 20 is moved in one direction or the other, in the central groove of the segment of profile 5 delimited by the components 6, 6, and 8 thereof (FIGS. 3 and 4) when moving the threaded rod 20*b* using an Allen key 6 through the corresponding opening 33 (FIG. 1). The nut 20*e* is a locking nut for which a socket wrench is necessary.

Several spring blocks 180, 190 and 200 can be positioned along the sides of the inner element 1*a* of the frame 1 described here. Corner blocks 21 fixed by screws 22 to the frame 1 guide the spring blocks in their position along the segments of profiles 5 when they move perpendicularly to such profiles.

As can be seen further down, the sealing blades 141, 142, 143, 144 provided with the longitudinal ribs 15 are so arranged as to provide the sealing of the glazing 2. A U-shaped stiffening profile 23, for which the longitudinal ribs 15 are the flanges (FIG. 5), is fixed on the whole length of the sealing blades 141, 142, 143, 144. Besides, stops 24 which play an essential part upon the locking, as will be seen in the following, are fixed on the lower ends of the two vertical sealing blades 143, 144 provided on the vertical uprights of the frame 1.

The encasement 3 bearing the glazing 2 is still to be described.

As can be seen in FIGS. 3, 4 and 5, the encasement 3 is composed of four segments of profiles 25 assembled in a quadrilateral by the ends thereof. They each have two first parallel flanges 26 oriented inwards the encasement 3, and used for guiding and holding two glass panes 2*a* and 2*b*, fixed to the encasement and held in position by cross-pieces 27. The segments of profiles 25 further have two second opposite flanges 28, perpendicular to the glazing plane and each provided with a groove 30 wherein a seal 291 is buried. Such seals 291 are of different structures: on the upper segment of profile 25, which can be seen in FIG. 3, the seals 291 are segments of plastic material beads having a U-shaped profile, whereas on the other three segments of profiles 25, which can be seen in FIGS. 3, 4 and 5, the seals 292 are segments of an elastic tube.

Finally, as can be seen in FIG. 3, the top and bottom profiles 25 are provided, in the middle of the length thereof, between the roots of the flanges 28, with a sectional plate 34 being provided with a hole which, upon assembling, engages on the dowels 13 to pivot the glazing.

The functions of the various components of the described device can easily be understood.

The Figures show the set in a locked position. To unlock and pivot the glazing 2, proceed as follows: first, control the screws 20*b* of the spring blocks 200, on the two vertical sides of the inner element 1*a* of the frame 1, so that the rods 20*a* are compressed. The vertical sealing blades 143, 144 move apart from the tubular seal 292. With same operation, stops 24 move apart and release the sealing blade 142 on the lower side of the frame 1. However, such blade will not move, since it is in a position which compresses the lower tubular seal 292 of the encasement 3 (FIG. 3). The sealing blade 142 must then simply be pressed to compress the rods 18*a*. As the spring blocks 190 have been adjusted beforehand, so that the sealing blade 141 can slightly rise when the U-shaped seal 291 presses the packing 31, the pivoting motion of the encasement 3 can be initiated and continued either until an intermediate position, or until a complete 180 degrees rotation is reached.

When reaching 180 degrees, if the sealing blade 142 has been released in the mean time, the inner flank 32 of the groove 30 opposite the one containing the tubular seal 292 previously compressed abuts against the widening 142*a* of the sealing blade 142. Simultaneously, the U-shaped seal 291 releases the sealing blade 141 bearing the packing 31, which fixes the final position of the glazing. Then the threaded rods 20*b* can be loosened again, which brings the vertical sealing blades 143, 144 back into their locking position and also locks the sealing blade 142 in the position compressing the tubular seals 292, through the action of the stops 24.

The position described offers two types of advantages.

First, it facilitates the cleaning and maintenance of the outer glass panes, which can mean, for example in the higher levels of a building, a significant saving on costs as well as valuable security.

It further enables an interesting functional improvement in that, when the glass panes 2*a* and 2*b* have different optical properties, interesting effects as regards the insulation and the lighting of rooms inside the building can be obtained. For example, if one of the faces of one of the glass panes 2*a* or 2*b* has particularly significant infrared light reflecting properties, the glazing can thus be turned so that such face is exposed to the sun in summer, so as to reduce the heating of the rooms inside, whereas such face will facilitate heating if it is turned inwards.

It should be noted that the pivoting axis of the glazing according to the invention need not be vertical. A glazing with a horizontal axis can also be provided, as explained above, with pivoting, locking and sealing means as described hereabove.

The invention claimed is:

1. An apparatus comprising a glazing provided with an encasement pivotally mounted about a pivot axis in a fixed opening frame, said glazing having an inner face and an outer face, said inner and outer faces being respectively positioned inside and outside a building in a closed position of the encasement, said encasement being arranged so as to enable the glazing to pivot about said pivot axis by 180 degrees, said encasement being sealable and lockable with respect to the frame, characterized in that the fixed opening frame includes one inner frame element and one outer frame element each having a quadrangular shape, said frame elements being formed by rectilinear segments and positioned against each other, the inner frame element being closer to the inside of the building relative to the outer frame element, in that said pivot axis of the encasement is borne by the outer frame element, in that the encasement includes segments, each provided with two first opposite flanges used for guiding and holding said glazing in the encasement, said first flanges being parallel to a vertical plane defined by the glazing and said pivot axis disposed between said two first opposite flanges, each of said encasement segments further including two second opposite flanges, each one of said second flanges being perpendicular to said vertical plane, a respective pair of said two second opposite flanges being symmetrical relative to said vertical plane and each of said second flanges being provided with a groove filled by a sealing member, for each of said respective pair of said second opposite flanges one of said grooves being positioned closer to the inside of the building relative to the other groove when the encasement is in said closed position, and in that the inner frame element is provided with mobile flat blades mounted on said rectilinear segments of said inner frame element, said mobile flat blades each define a surface and are moveable parallel to said pivot axis between a first position and a second position, said mobile flat blades being closer to said second flanges in the second position than in the first position and cooperating in said second position with said sealing members of said closer grooves when the encasement is in said closed position so as to provide the sealing of the encasement with respect to the frame.

2. The apparatus according to claim 1, characterized in that said glazing comprises at least two glass panes having different properties enabling the glazing to reflect sun radiation and insulate.

3. The apparatus according to claim 1, wherein the sealing members of the segments of the encasement comprise four segments forming a quadrilateral, wherein three of said encasement segments comprise tubular seals and the sealing members of the fourth of said encasement segments comprise U-shaped seals.

4. The apparatus according to claim 3, wherein said mobile flat blades of the frame are borne by spring blocks, each of said spring blocks being received in a U-shaped inner space of said segments of said inner frame element.

5. The apparatus according to claim 4, wherein as said mobile flat blades move from the first position towards the second position, the mobile flat blades press against said sealing members of said closer grooves when the encasement is in said closed position.

6. The apparatus according to claim 5, wherein said grooves comprise inner flanks, each of said inner flanks of said closer grooves of the three of said encasement segments having tubular seals abuts a respective one of said mobile flat blades when the encasement is in the closed position and said respective one of said mobile flat blades is in said second position.

7. The apparatus according to claim 6, further comprising stops, said stops are engagable with a respective one of said mobile flat blades to prevent downward movement of the respective one of said mobile flat blades when the encasement is in the closed position and said respective one of said mobile flat blades is in said second position.

* * * * *